US006367218B2

(12) United States Patent
Lombardo

(10) Patent No.: US 6,367,218 B2
(45) **Date of Patent: *Apr. 9, 2002**

(54) REMOVABLE TILE WALL COVERING

(76) Inventor: Jamie A. Lombardo, 7 Charisma Dr., Camp Hill, PA (US) 17011

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/370,556

(22) Filed: Aug. 9, 1999

(51) Int. Cl.[7] ..... E04B 2/00

(52) U.S. Cl. ..... 52/506.05; 52/311.2; 52/391; 52/506.01

(58) Field of Search ..... 52/311.2, 391, 52/506.01, 506.05

(56) References Cited

U.S. PATENT DOCUMENTS

| | | | | | |
|---|---|---|---|---|---|
| 3,378,974 | A | * | 4/1968 | Bush | 52/506.05 |
| 3,744,199 | A | | 7/1973 | Navarre | 52/211 |
| 4,018,260 | A | | 4/1977 | Baslow | 160/327 |
| 4,157,408 | A | * | 6/1979 | Lingl | 427/209 |
| 4,197,686 | A | | 4/1980 | Baslow | 52/273 |
| 4,271,566 | A | | 6/1981 | Perina | 24/204 |
| 4,275,520 | A | | 6/1981 | Appleton et al. | 40/605 |
| 4,353,193 | A | | 10/1982 | Sanderson | 52/311 |
| 4,577,444 | A | | 3/1986 | Sanderson | 52/311 |
| 4,635,418 | A | | 1/1987 | Hobgood | 52/239 |
| 4,709,453 | A | | 12/1987 | Harvey et al. | 24/442 |
| 4,744,189 | A | | 5/1988 | Wilson | 52/511 |
| 4,796,397 | A | | 1/1989 | Capaul | 52/144 |
| 4,863,127 | A | | 9/1989 | Handler | 248/205.2 |
| 4,984,339 | A | | 1/1991 | Provost et al. | 24/452 |
| 5,067,210 | A | | 11/1991 | Kayaki | 24/452 |
| 5,131,119 | A | | 7/1992 | Murasaki et al. | 24/452 |
| 5,134,822 | A | | 8/1992 | Edlin | 52/273 |
| 5,175,969 | A | | 1/1993 | Knauf et al. | 52/239 |
| 5,179,767 | A | | 1/1993 | Allan | 24/442 |
| 5,212,853 | A | | 5/1993 | Kaneko | 24/452 |
| 5,259,163 | A | | 11/1993 | Pacione | 52/511 |
| 5,271,200 | A | * | 12/1993 | Witt | 52/391 |
| 5,339,499 | A | | 8/1994 | Kennedy et al. | 24/452 |
| 5,361,462 | A | | 11/1994 | Murasaki | 24/452 |
| 5,392,498 | A | | 2/1995 | Goulait et al. | 24/452 |
| 5,412,918 | A | | 5/1995 | Wendel et al. | 52/582.1 |
| 5,518,795 | A | | 5/1996 | Kennedy et al. | 428/100 |
| 5,669,120 | A | | 9/1997 | Wessels et al. | 24/446 |
| 5,685,050 | A | | 11/1997 | Muraski | 24/449 |
| 5,691,026 | A | | 11/1997 | Zinke et al. | 428/100 |
| 5,747,153 | A | * | 5/1998 | McDaniel | 428/324 |

FOREIGN PATENT DOCUMENTS

| | | | | |
|---|---|---|---|---|
| DE | 2624538 | * | 2/1977 | 52/506.01 |
| DE | 4317900 | * | 12/1993 | 52/506.01 |

* cited by examiner

*Primary Examiner*—Jerry Redman
(74) *Attorney, Agent, or Firm*—Thomas Hooker, P.C.

(57) ABSTRACT

A removable tile wall covering includes a number of ceramic tiles held on the wall surface with disengageable-reengageable VELCRO fasteners. The wall covering is simple and inexpensive to install, and the tiles are easily removed for cleaning or redecoration.

9 Claims, 4 Drawing Sheets

REMOVABLE TILE WALL COVERING

FIELD OF THE INVENTION

The present invention relates to a removable wall covering.

BACKGROUND OF THE INVENTION

Ceramic wall tile is a popular wall covering commonly used in kitchens or baths. The tile is permanently attached to a wall using mortar or tile adhesive. The tiles are spaced apart with the front faces of the tile facing the room and the rear faces of the tile set in the adhesive. Grout fills the spaces between the sides of the tiles to form a hard, durable and watertight wall covering.

Conventional ceramic wall tiles are available in a wide variety of colors and patterns. However, only the front face of each tile is colored and glazed. The coloring agent and glazing agent are conventionally applied to the front face prior to the tile being fired in a kiln. The rear face and sides of the tile are hidden from view when installed and so are not colored or glazed. The rear and sides are also often grooved to enhance adherence of the adhesive and grout to the tile.

The sides of conventional ceramic wall tile are unfinished and irregular and do not define a constant gap between adjacent tiles. Instead, the grout is relied upon to give the appearance of a smooth, regular spacing between tiles. Specially shaped bullnose tiles must be used along the outer perimeter of the tiles to create a finished edge.

The tiles are selected so that the assembled tiles form a pleasing decorative wall pattern compatible with the color scheme or interior decoration of the room. Many find the aesthetic beauty of a ceramic wall an advantage over other wall coverings.

However, the permanent nature of conventional tile wall coverings is a disadvantage if redecoration is desired. Removing or replacing tile is dirty, inconvenient and expensive. As a result, tiles are not changed and an original tile pattern or color scheme remains a permanent part of the room. Yet many homeowners prefer to seasonally decorate room interiors, or wish to change color schemes occasionally. Thus the homeowner chooses either not to install ceramic tile, or to install the tile and lose the ability to redecorate the tiled portions of the wall.

Conventional ceramic tile wall coverings have a number of other disadvantages. Installing the tile with mortar and grout can be intimidating as a do-it-yourself home improvement, and skilled installation is expensive. Replacing damaged or stained tiles is difficult and may damage the wall. The tiles cannot be removed for cleaning.

Thus there is a need for an improved tile wall covering. The tiles should be easily removable for cleaning or replacement, and the tiles should be easily and inexpensively installed.

SUMMARY OF THE INVENTION

The present invention is directed to an improved tile wall covering having tiles that are removably attached to the wall. The wall covering is simple and inexpensive to install, and the installed tiles are easily removable for cleaning or replacement.

A tile wall covering having features of the present invention includes a number of rigid tiles fastened to a wall with a disengageable-reengageable fastener that is designed to removably fasten two items together. Adhesive cement or grout is not needed, making for easy installation.

The fastener may be a pressure type or contact type such as a hook and loop type fastener. One portion of the fastener is attached to the tile and the other portion of the fastener is attached to the wall. The wall can be a conventional wall suitable for installing conventional ceramic tile. The tiles are pressed against the wall so that the fastener portions removably hold the tiles to the wall. The tile can be removed by pulling the tile away from the wall.

The tiles are preferably mounted on the wall with each tile abutting its neighboring tiles to form a continuous wall covering. The sides of the tile are finished and smooth so that practically gap-free joints extend along the abutting sides of the tiles. The finished sides also suitably finish the outer perimeter of the tiles. Bullnose tiles or other specialized perimeter tiles are not needed.

The front face of each tile is colored so that the assembled tiles form a predefined pattern or color scheme. The color of each tile preferably extends to and covers the sides of the tile. It has been found that if the sides of the tiles are left uncolored, a line effect may be seen between the tiles that may detract from the overall appearance of the assembled tiles. If desired, the edges of the tile may be left uncolored or may be colored in a contrasting color from that of the front face to accentuate the line effect.

In a first embodiment, the tiles are substantially flat and planar ceramic tiles. The attached fastener portions adhere to the rear face. When the tiles are held on the wall, the fasteners are located between the rear surface of the plate and the wall and space the tiles off the wall.

In a second embodiment, the fastener portions are attached to fastener surfaces spaced inwardly from the rear face of the ceramic tile. The fastener surfaces are sufficiently recessed so that the rear face of the tile can be held flush against the wall.

The wall covering of the present invention may be provided as a kit. The kit includes a plurality of tiles to cover a predetermined wall area. The fasteners are preferably included as a separate component to be attached to the tiles and the wall during installation of the tiles. The kit could be used for new installations or for redecorating existing installations of the present invention.

Other objects and features of the invention will become apparent as the description proceeds, especially when taken in conjunction with the accompanying drawings illustrating two embodiments of the invention, of which there are four sheets.

DESCRIPTION OF THE PREFERRED EMBODIMENT

Figure 1:
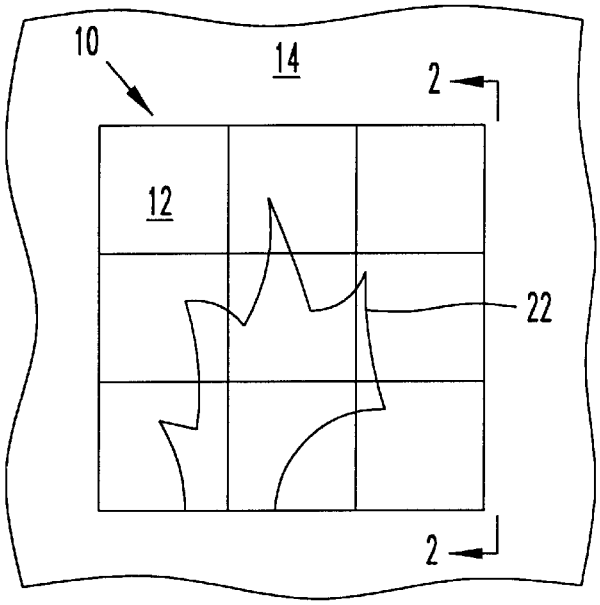
FIG. 1 is a front view of a first embodiment wall covering formed in accordance with the present invention.
Figure 2:
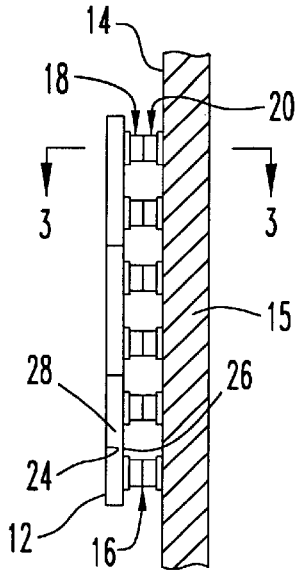
FIG. 2 is a side sectional view of the wall covering shown in FIG. 1 and taken along the lines 2—2 of FIG. 1.
Figure 3:
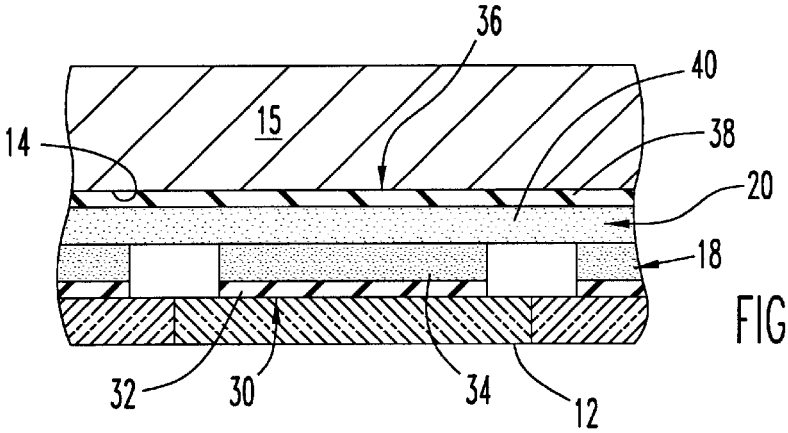
FIG. 3 is a top sectional view of the wall covering shown in FIG. 2 and taken along lines 3—3 of FIG. 2.

FIGS. 1 through 3 illustrate a first embodiment tile wall covering 10 formed in accordance with the present invention. The covering 10 is intended as a decorative back splash behind a kitchen counter or oven.

The wall covering 10 includes a plurality of ceramic tiles 12 attached to a surface 14 of a wall 15 by a hook and loop fastener 16 located between the tiles and the wall surface. The hook and loop fastener is preferably a commercially available VELCRO brand fastener. The fastener 16 includes hook portions 18 attached to the tiles and loop portions 20 attached to the wall surface 14. The hook portions engage and mesh with the loop portions to hold the tiles to the wall.

The tiles 12 are arranged in a side-by-side relationship with each tile preferably abutting neighboring tiles with no substantial gaps between tiles. The tiles 12 cover a generally square plan outline of the wall and are differentially colored and arranged to display a decorative pattern 22. Other plan outlines and patterns are equally feasible, and if desired the tiles can display a uniform color. The remainder of the wall may be covered by a conventional wall covering (not shown).

Each tile 12 is substantially square and includes a front face 24 and a rear face 26. The rear face is substantially flat to conform to the wall surface 14. Sides 28 extend between the faces at the periphery of the tile. The sides of the tile are finished smooth and straight to form closely fitting, practically gap-free joints with the abutting sides of neighboring tiles. The entire surface of the tile is glazed, including the front face, rear face and sides of the tile to form a nonabsorbent surface. The front face 24 and sides 28 are colored. The tile's rear face can be left uncolored.

Figure 4:
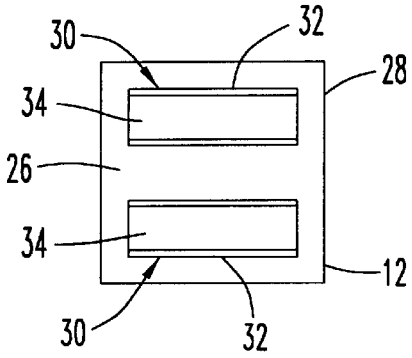
FIG. 4 is a rear view of a tile shown in FIG. 3.

The hook portions 18 include a number of hook strips 30, with a pair of hook strips 30 attached to each rear face 26 of the tiles 12. See FIG. 4. Each hook strip 30 is spaced inwardly from the top or bottom edge of the rear face and extends parallel with the other hook fastener along the width of the rear face. Preferably the ends of the hook strips 30 are spaced inwardly about one-half inch from either side of the tile. Each hook strip 30 includes a self-adhesive layer 32 that adheres to the rear face of the tile and an outer fibrous hook layer 34 that faces away from the tile.

Figure 5:
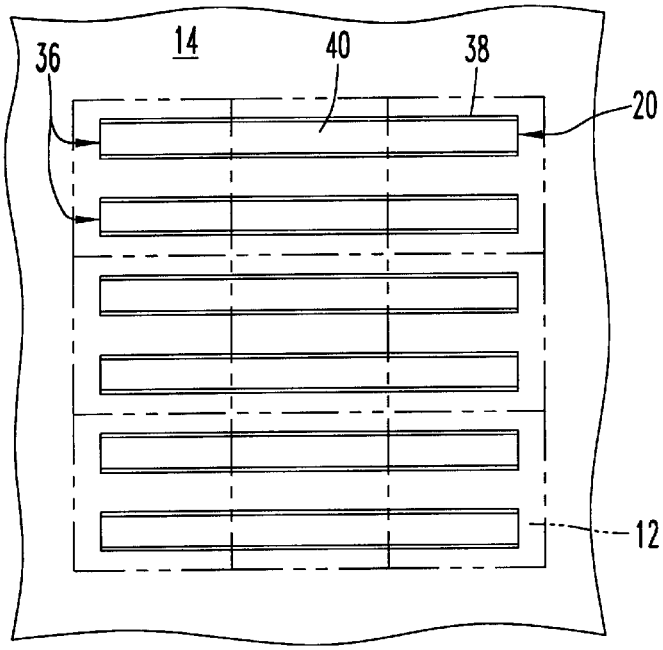
FIG. 5 is a front view of the wall system shown in FIG. 1 with the tiles shown in phantom.
Figure 6:
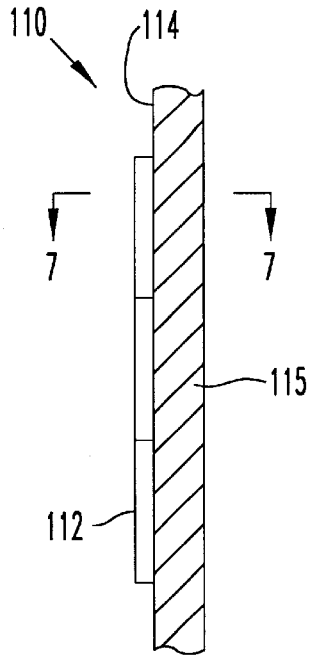
FIG. 6 is similar to FIG. 2 but is a side view of a second embodiment wall system.

FIG. 5 is similar to FIG. 1 except the tiles are shown in phantom to better illustrate the placement of the loop portions 20 on the wall. The loop portion 20 includes a number of horizontal, spaced apart loop strips 36 extending nearly the width of the outline. Preferably the ends of the loop strips 36 are spaced about one-half inch inwardly from the outer perimeter of the outline. Each loop strip 36 includes a self-adhesive layer 38 that adheres to the wall surface 14 and a fibrous loop layer 40 that faces away from the wall surface.

To attach the tiles 12 to the wall 15, each tile 12 is positioned with its rear face facing the wall and is then pressed against the wall surface 14. The hook strips 30 and loop strips 36 are positioned on the tiles and wall so that when the tile is in the desired position, fibrous hook layers 34 and fibrous loop layers 40 overlie one another. Pressing the tile against the wall intermeshes the hook and loop layers to hold the tile to the wall.

The tile is held away from the wall by the thickness of the intermeshed hook and loop layers, see FIGS. 2 and 3. The gap between the tiles and the wall is exaggerated in FIGS. 2 and 3 for clarity. The ends of the hook and loop strips 30, 36 are spaced inwardly from the outer perimeter of the outline and so are not normally visible after the tiles are installed.

The tiles 12 preferably abut one another to form tightly fitting joints between neighboring tiles. The abutting tiles hide from view the loop strips 36 extending between adjacent tiles and resist the flow of liquids between the tiles.

FIGS. 6–10 illustrate a second embodiment wall covering 110 having a plurality of ceramic tiles 112 attached to a wall surface 114 of a wall 115 by a hook and loop fastener 116. The tiles 112 cover the same outline of the wall and display the same decorative pattern as wall covering 10 but lie flush with the wall surface 114. See FIGS. 6 and 7.

Each ceramic tile 112 includes a pair of fastener surfaces 118 recessed inwardly about an eighth of an inch from a rear face 120 of the tile and defining a pair of recesses or cavities 121. See FIGS. 8 and 9. The fastener surfaces 118 do not extend the full width of the tile. The hook and loop fastener 116 includes a hook strip 122 attached to each fastener surface 118. The hook strip 122 includes a self-adhesive layer 124 adhering the hook strip 122 onto the fastener surface 118 and a fibrous hook layer 126.

Figure 10:
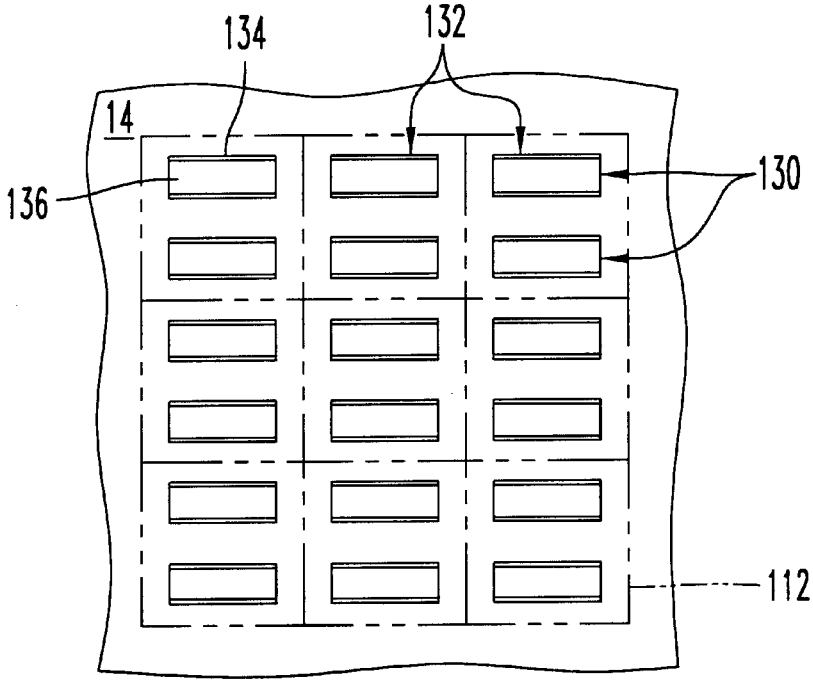
FIG. 10 is a front view of the second embodiment wall system but with the tiles shown in phantom.

The hook and loop fastener 116 includes a number of horizontal rows 130 of spaced apart loop strips 132. FIG. 10 illustrates the placement of the loop strips 132, with the location of the tiles 112 shown in phantom. Each loop strip 132 has a length that corresponds to the length of the hook strips 122. The loop strips 132 include a self-adhesive layer 134 adhering to the wall 114 and an outer fibrous loop layer 136.

Figure 7:
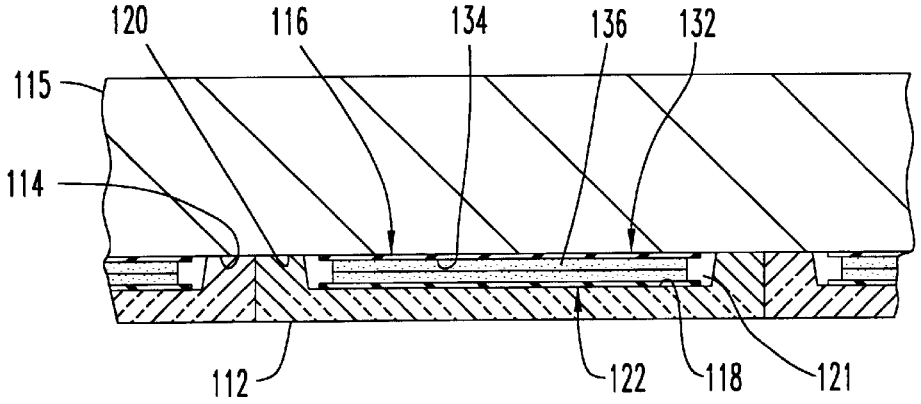
FIG. 7 is a top sectional view of the wall covering shown in FIG. 6 and taken along the lines 7—7 of FIG. 6.
Figure 8:
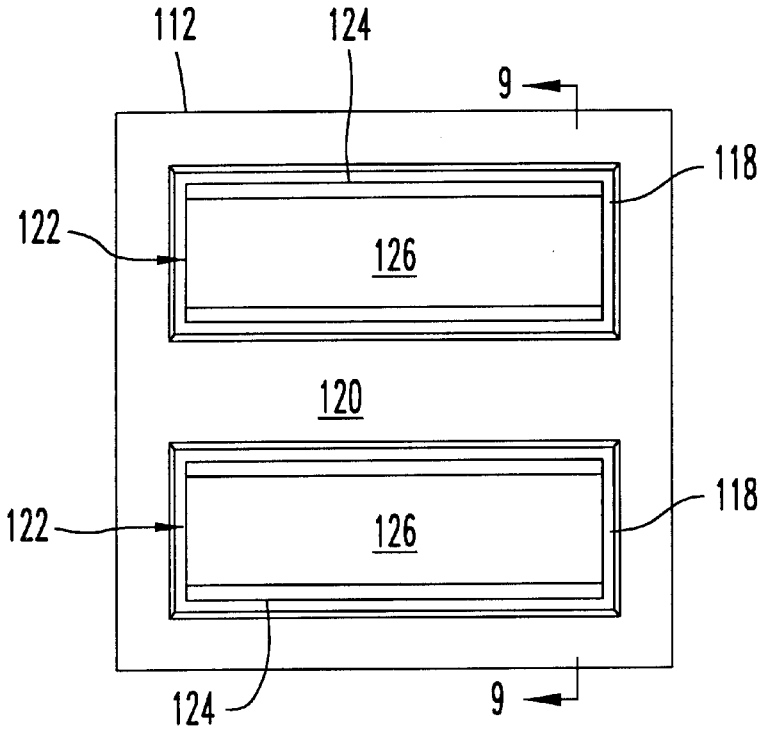
FIG. 8 is a rear view of a tile shown in FIG. 7.
Figure 9:
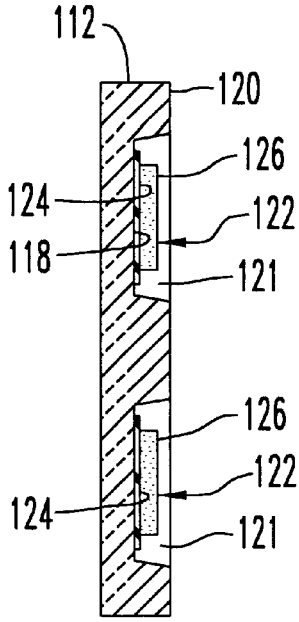
FIG. 9 is a side sectional view of the tile shown in FIG. 8 taken along line 9—9 of FIG. 8.

The tiles 112 are pressed against the wall surface 114 to fasten the tiles to the wall. When a tiles 112 is properly positioned, the pair of hook strips 122 overlie a corresponding pair of loop strips 132. Pressing the tile engages the fibrous hook and loop layers 126 and 136 to hold the tile against the wall surface 114. As shown in FIG. 7, the engaged hook and loop strips 122, 132 are contained within the tile recesses 121 and the rear faces 120 of the tiles 112 lie snugly against the wall.

Figure 11:
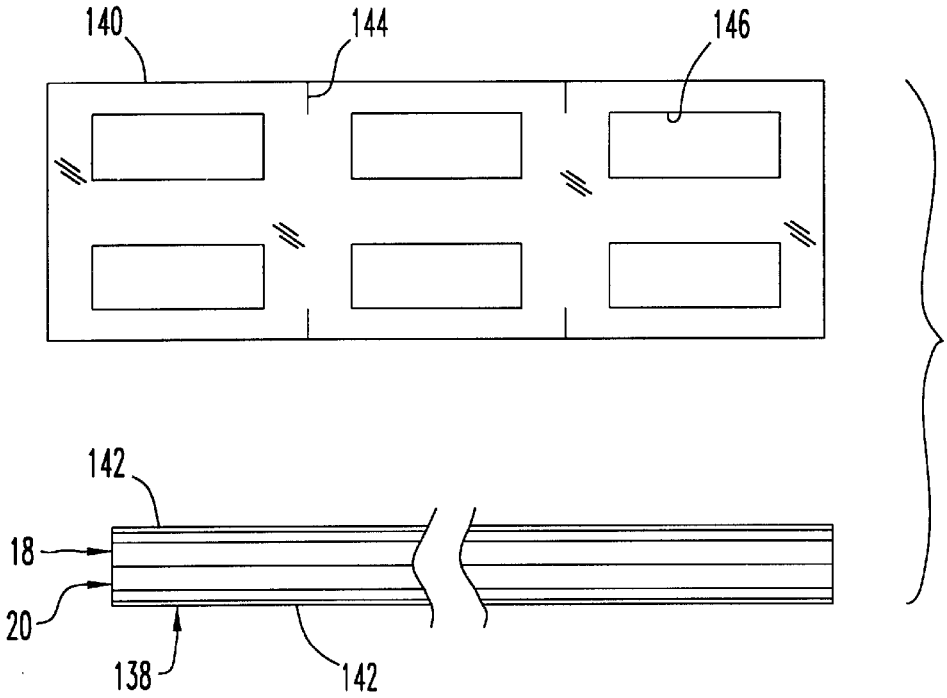
FIG. 11 illustrates two components of a wall covering kit in accordance with the present invention.

The wall covering of the present invention may be provided as a kit. The kit includes a plurality of tiles 12 or 112, a length of commercially available hook and loop fastener 138 and a template 140 for marking the walls. See FIG. 11. The hook and loop fastener 138 is cut into a number of fasteners of appropriate lengths when installing the tiles on the wall. The fastener 138 includes peelable outer protective layers 142 that are removed to expose the self-adhesive prior to installation. If desired, the hook and loop fastener 138 may be precut into a number of fasteners to be included in the kit, or the fastener portions could be preattached to the tiles of the kit.

The template 140 is preferably a clear plastic panel representing a row of the ceramic tiles, although alternatively the template may cover the entire multi-row plan outline. The template may include markings 144 indicating the locations of the tiles along the row and may have cutouts 146 corresponding to the location of the fasteners on the rear face of the tile or on the wall. Other reference markings may be included.

The template is placed against the wall surface and the locations of the fasteners and tile edges are marked on the wall by tracing along the edges of the template. If necessary, the tiles may then be placed against the template and the locations of the fastenings on the rear face of each tiles marked. Such marking is unnecessary for the tiles 112 because the recessed fastener surfaces inherently locate the fasteners. The fastener strips are then cut to the appropriate lengths and separated, with the hook fasteners applied to the tiles and the loop fasteners applied to the wall at the places marked. The tiles are aligned with the marked edges and pressed against the wall to assure that the sides of neighboring tiles closely abut one another.

Although the tiles are shown covering a generally square plan outline, it is understood that the tiles may have curved or irregular edges for forming curved or irregular outlines. It is not necessary that all of the tiles be identically shaped, and differently shaped and sized tiles may be intermixed as desired.

A tile wall covering in accordance with the present invention presents a pleasing appearance to the eye. The exposed tile sides at the perimeter present a finished appearance, and the interior tiles form a substantially smooth and continuous wall covering. The installed tiles can be easily removed from the wall for cleaning, or other tiles can be substituted for a quick and easy room redecoration. The wall covering is suitable for both home and commercial applications wherever ease of installation, cleaning and replacement is desirable.

While I have illustrated and described a preferred embodiment of my invention, it is understood that this is capable of modification, and I therefore do not wish to be limited to the precise details set forth, but desire to avail ourselves of such changes and alterations as fall within the purview of the following claims.

What I claim as my invention is:

1. In combination with a wall having a surface, a back splash for protecting the wall surface from liquids or steam, said back splash comprising:

a plurality of rigid ceramic tiles held on the wall surface, each tile having an exterior glazed over the entirety thereof, the exterior comprising a front face facing away from the wall surface, an opposite rear face facing the wall surface and sides extending between the front and rear faces, the rear face of the tile being flat, the sides of the tile abutting the sides of adjacent tiles and being finished to form mortar-free and gap-free joints with the abutting sides of adjacent tiles to substantially obstruct the flow of liquids or steam between adjacent tiles, and the front face and sides of the tile being colored whereby the back splash presents a predetermined ornamental pattern; and fasteners located between the wall surface and each of the tiles, each fastener having a first side member attached to the wall surface, a second side member attached to the rear face of each tile and a disengageable-reengageable connection between said members wherein the tiles are removably held to the wall surface solely by the fasteners.

2. The back splash of claim 1 wherein each tile includes a recessed fastener surface facing the wall surface and spaced inwardly from the rear face of the tile, the second side member of each fastener attached to a recessed fastener surface.

3. The back splash of claim 1 wherein said first fastener connection includes one of a hook fastener and a loop fastener attached to each first fastener member and the other of a hook fastener and a loop fastener attached to each second fastener member.

4. A back splash kit for removably fastening ceramic tiles in a predefined arrangement to form a back splash on a surface of a wall, said kit comprising:

a plurality of ceramic tiles, each tile being glazed over its entire surface and having a front face and an oppositely facing rear face, the rear face being flat and configured to face towards the wall surface when the tile is fastened to the wall, and sides extending between the front and rear faces, the sides of each tile being configured to abut the sides of adjacent tiles and form gap-free and grout-free joints between the tiles to obstruct the flow of liquids or steam between adjacent tiles when the tiles are fastened to the surface of the wall, the front face and sides of the tile being colored wherein the back splash displays a predefined decorative pattern when the tiles are fastened to the wall in such a predefined arrangement; and a fastener for removably fastening the tiles to the wall surface, said fastener having a first member being configured to be attached to the wall, a second member being configured to be attached to the rear face of each tile, and a disengageable-reengageable connection between said members configured to removably fasten the tiles to the wall whereby the fastener fastens the tiles to the wall surface with abutting tile sides to form a backsplash without grout between the tiles.

5. The kit of claim 4 comprising a template to locate the tiles on the surface of the wall.

6. The kit of claim 4 wherein said fastener connection includes a hook and loop fastener.

7. The kit of claim 4 wherein said fastener members are separate from and unattached to the tiles.

8. The kit of claim 4 wherein said second fastener member includes a plurality of members, each of the plurality of members attached to a rear face of a tile.

9. The kit of claim 4 wherein each tile includes a fastener surface recessed inwardly from the rear face of the tile for attaching a portion of the second member of the fastener.

* * * * *